United States Patent [19]

Tutikawa

[11] Patent Number: 4,704,819

[45] Date of Patent: Nov. 10, 1987

[54] FLAT SLIDING DOOR UNIT

[76] Inventor: Yosiji Tutikawa, Hiranonishi 3-7-20, Hirano-ku 547, Osaka, Japan

[21] Appl. No.: 856,932

[22] Filed: Apr. 25, 1986

[51] Int. Cl.[4] ..... E05D 15/20

[52] U.S. Cl. ..... 49/129; 49/148; 49/213; 16/95 R; 16/102

[58] Field of Search ..... 49/127, 129, 130, 213, 49/216, 218, 225, 148, 128; 16/87 B, 95 R, 102

[56] References Cited

U.S. PATENT DOCUMENTS

| | | | |
|---|---|---|---|
| 1,109,071 | 9/1914 | Judia | 49/213 |

FOREIGN PATENT DOCUMENTS

| | | | |
|---|---|---|---|
| 0124196 | 11/1984 | European Pat. Off. | 49/220 |
| 0992378 | 10/1951 | France | 49/215 |
| 141679 | 8/1984 | Japan . | |
| 106710 | 3/1943 | Sweden | 49/129 |
| 109128 | of 1917 | United Kingdom | 49/130 |

*Primary Examiner*—Kenneth J. Dorner
*Assistant Examiner*—Gerald A. Anderson
*Attorney, Agent, or Firm*—Lowe, Price, LeBlanc, Becker & Shur

[57] ABSTRACT

A flat sliding door unit comprising a main rail extending in the right and the left directions along the upper door frame; swing arms provided aside the main rail and supported by the upper door frame or an extension thereof; sliding doors, each of which is provided with a pair of rollers to be shifted along the main rail and secured to upper both ends of the sliding door; wherein the swing arm is provided with an engaging pin at the tip thereof; a hook member to detachably engage the engaging pin and extending from the roller stay disposed on the leading end in the opening direction of the sliding door; an opening part of the hook member being directed in a fixed direction so as to depart from the engaging pin when the sliding door is slid along the main rail in the opening direction; the sliding door being retained in the closure position when the hook member engages the engaging pin; and, upon swinging of the sliding door to one side, the swing arm swings to shift the roller retaining the swing arm to a door-movement-starting position on the main rail.

6 Claims, 13 Drawing Figures

FLAT SLIDING DOOR UNIT

BACKGROUND OF THE INVENTION

This invention relates to a flat sliding door unit used for furniture or fittings, and more particularly to a flat sliding door unit in which a sliding door is on the same vertical flat plane as that of the adjacent sliding door, or adjacent stationary wall when closed and, when intended to be opened, is shifted to the front side of the abovesaid adjacent sliding door or stationary wall.

A flat sliding door unit of the type wherein a door on one side, when intended to be opened, is swung like a hinged door to one side at one end thereof adjacent to the neighboring door and then slid sideways, is disclosed, for example, in Japanese Patent, Laid-open No. 141679/1984. In this unit, side lead-in rails are connected to the main rail extending in the right and the left directions at approximate right angles with respect to the main rail, and rollers fixed to abutting end portions of the sliding doors are mounted on slides fitted into these lead-in rails.

However, in this structure, noise is emitted from the junction of the slide and the main rail when the roller is shifted from the slide to the main rail, and a groove must be formed on the main rail for fitting the slide thereinto smoothly because the slide and the upper surface of the main rail must be flush with each other. Accordingly, unless a junction of the lead-in rail including the slide and the main rail are in considerably high precision, not only is rolling of the roller uneven and setting of the furniture is troublesome, but also a groove formed across the elongate main rail causes significant decrease in the rail strength. Moreover, this known structure encounters such problems that, since a roller supporting stay on the door on one side cannot pass through that on the door on the other side, installation of a roller stay at the leading end (the end of a door abutting on that of the other door) is impossible and a sliding door is hung at one side thereof, whereby the structure is unsuitable for the use in a heavy door. These problems are not limited to the sliding door unit of the two-step action type, i.e., swing-and-slide type, as described above but are also caused in known flat sliding door units of the type in which side rails are connected to the main rail.

SUMMARY OF THE INVENTION

Therefore, a primary object of this invention is to provide a flat sliding door unit of a novel structure which avoids drawbacks existing in the conventional unit as described above.

BRIEF DESCRIPTION OF THE DRAWINGS

The drawings show embodiments of this invention, wherein.

PREFERRED EMBODIMENT OF THE INVENTION

Figure 1:
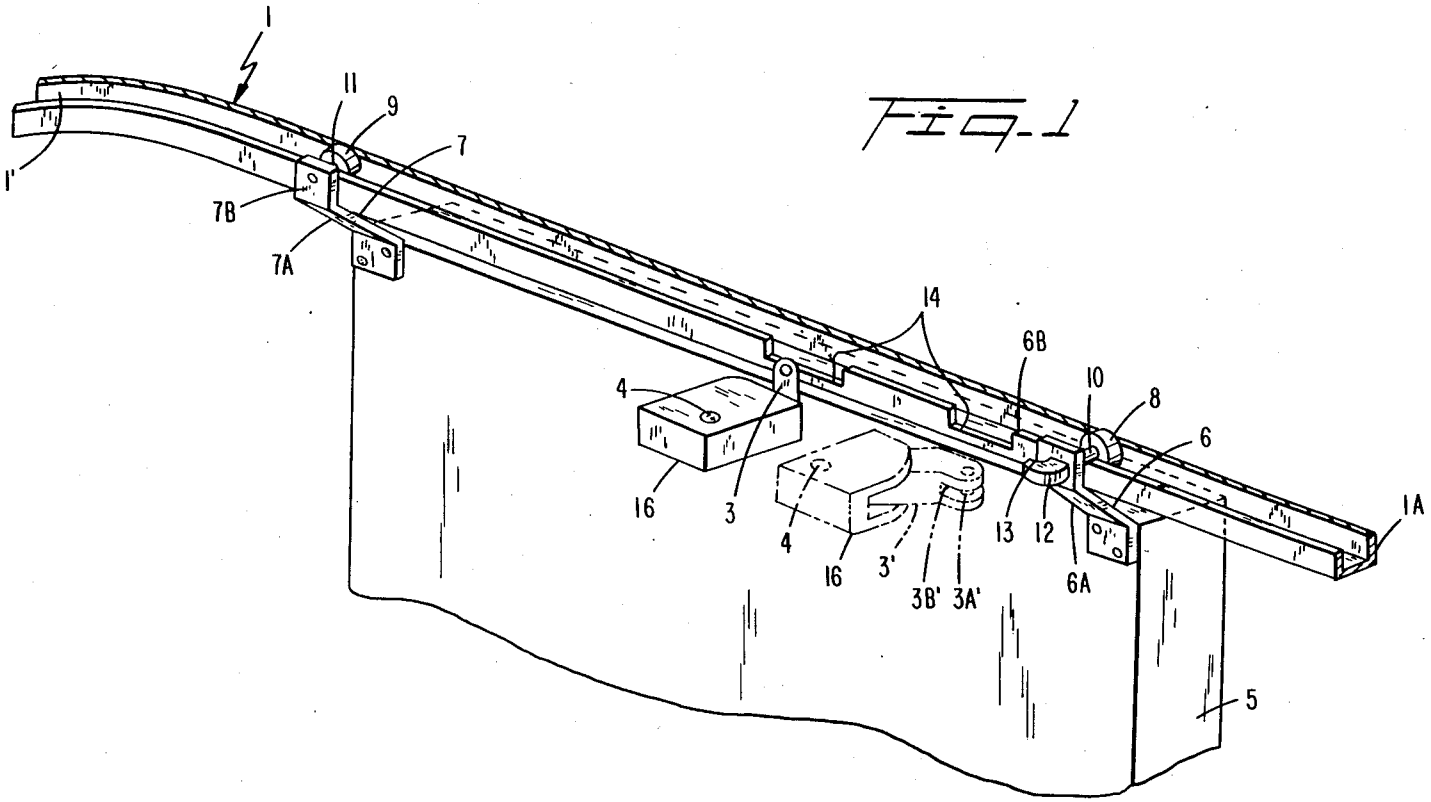
FIG. 1 is a perspective view of a major part of an embodiment taken from the rear side thereof.

FIGS. 1 through 6 are views of an embodiment of this invention wherein a main rail 1 is fixed to a door frame 2 of the stationary body frame of a piece of furniture so as to extend in the right and left directions. Both ends of the main rail 1 extend obliquely rearwardly and are bent to be each formed into a side lead-in rail 1'. The main rail is channel shaped in cross- section for permitting rollers that will be described later to roll thereon. In the embodiment, a side end 1A of the main rail lying on the front side of the furniture extends lengthwise and is fixed to the back of the door frame 2. A pair of swing arms 3 and 3', which are disposed right and left in proximity to the central portion of the main rail 1 and swing from the inner portion of the furniture toward the main rail while kept horizontal in posture, are each fixed to a support 16 secured to the ceiling board of the furniture in such a way so that they swing around a vertical axis 4. The swing arms 3 and 3' are provided with engaging pins 3A and 3A' as well as stops 3B and 3B', respectively, at tip parts thereof. On the other hand, rolling bodies, for example, rollers 8, 8' and 9, 9' to roll along the abovesaid main rail, are provided at both ends of the tops of a pair of sliding doors 5 and 5' disposed left and right through rollers stays 6, 6' and 7, 7', respectively. These roller stays each have a horizontal part 6A or 7A extending rearwardly and approximately horizontally from the rear side of and higher than the sliding door, the extending end part being raised upright to be a raised part 6B or 7B which supports any of the abovesaid rollers through a shaft 10 or 11. The roller stay 6 or 6' at the leading end on the opening side of the sliding door (the side to abut on the neighboring door) is provided with a hook member 12 horizontally extending in the direction opposite to the roller, that is, toward the rear side of the furniture, the hook member being provided with an engaging recess 13 or 13' to detachably engage the abovesaid engaging pin 3A or 3A'. The open face of the abovesaid engaging recess is directed toward a door closure direction.

Figure 2:
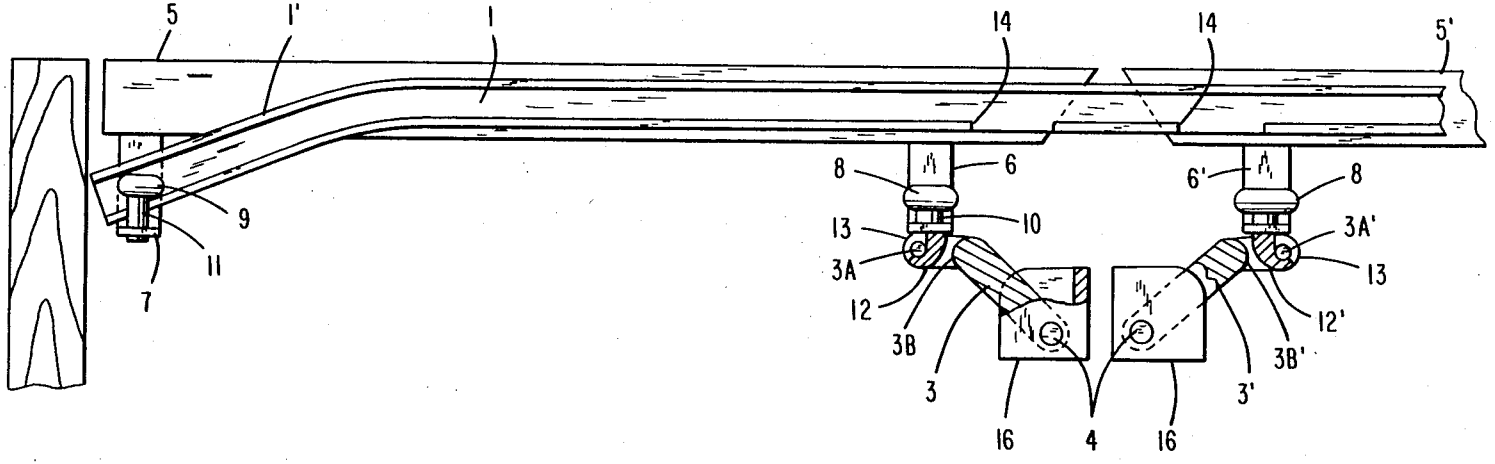
FIG. 2 partial sectional plan view of a major part of the embodiment.

In FIG. 2, the left and the right sliding doors 5 and 5' are closed. When a sliding door on one side, for example, the door 5 on the left side, is swung to the other side (upper side in the drawing), the swing arm 3 turns by an angle of about 60° around the axis 4 to dispose the roller 8 in a position for starting of door movement on the main rail (See FIG. 3). A pair of gateways 14 are provided on the rear side wall 1B of the main rail to enable the rollers 8 and 9 to move onto the main rail while running on the same level as that of the main rail. Then, the sliding door is slid rightward and thereby can be shifted to the front side of the other sliding door 5 as shown in FIG. 4.

At this time, since the roller stay 6 extends approximately horizontally and rearwardly from the surface of the sliding door through a position higher than the top end of the sliding door, and an extending end of the horizontal part 6A is raised to be a raised part 6B which is provided with a shaft 10 for the roller 8 so that the roller 8 is ridden on the main rail through the rear side of the rail, the horizontal part 6A of the roller stay 6 is in a state as if hung above the top end of the other door and is shifted without being impeded by the other door.

In the case of shifting as above, the roller 8' of the other door 5' is hung by the swing arm 3 used exclusively for this roller as shown in the drawing to be laid aside the path, that is, in the inner part of the furniture, and prevented from being impeded by the moving door.

Figure 3:
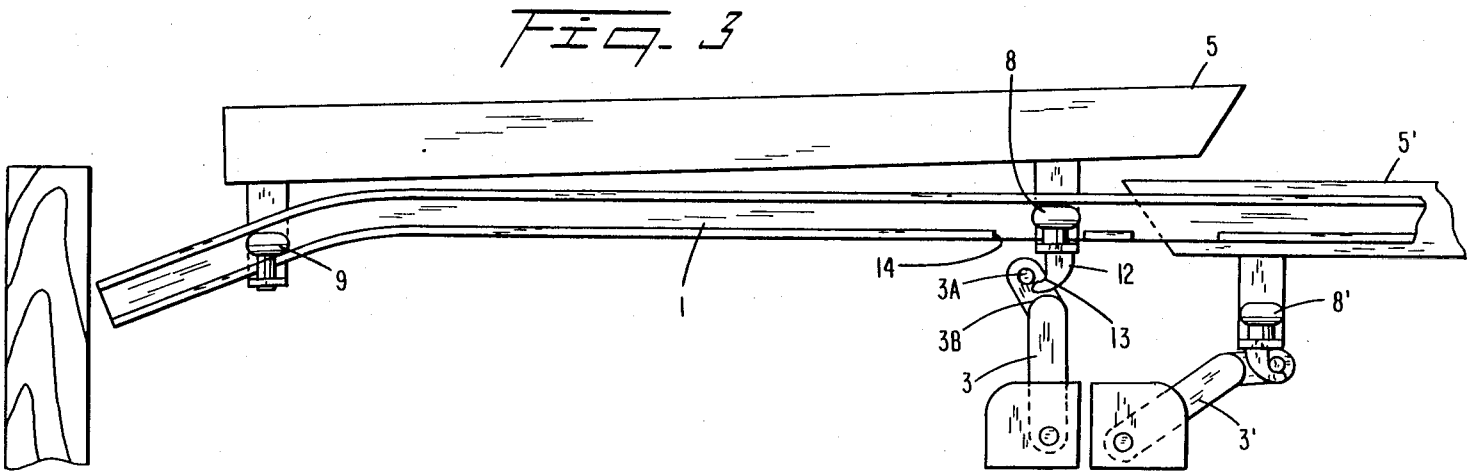
FIGS. 3 and 4 are plan views showing a state of performance of the embodiment.
Figure 4:
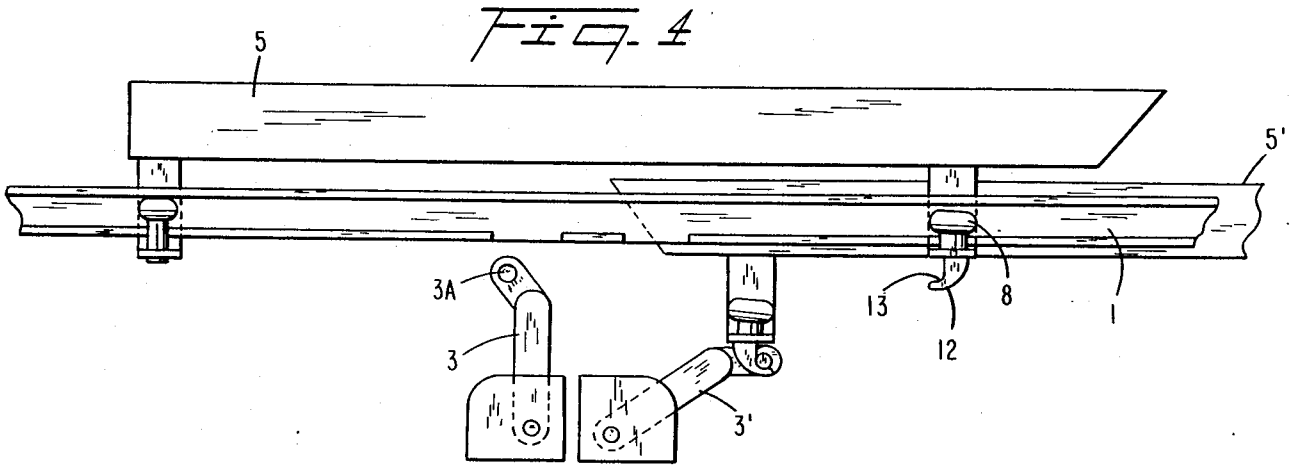

In closing the sliding door 5, the engaging recess 13 fits on the engaging pin 3A of the swing arm prepared for moving as shown in FIG. 3 upon leftward drawing of the sliding door in the procedure reverse to that for the abovesaid performance.

Afterward, when the door is pushed inwardly, the engaging pin and recess, while maintained in engagement with each other, turn the swing arm 3 counterclockwise to a withdrawal position as shown in FIG. 2, the sliding door thereby being closed to return to a position on the flat plane. Though not shown in the drawing, an energizing spring having an appropriate catcher or dead point is preferably attached to the swing arm for forcibly maintaining the posture of the swing arm as it is in position for opening and closing the sliding door.

Figure 5:
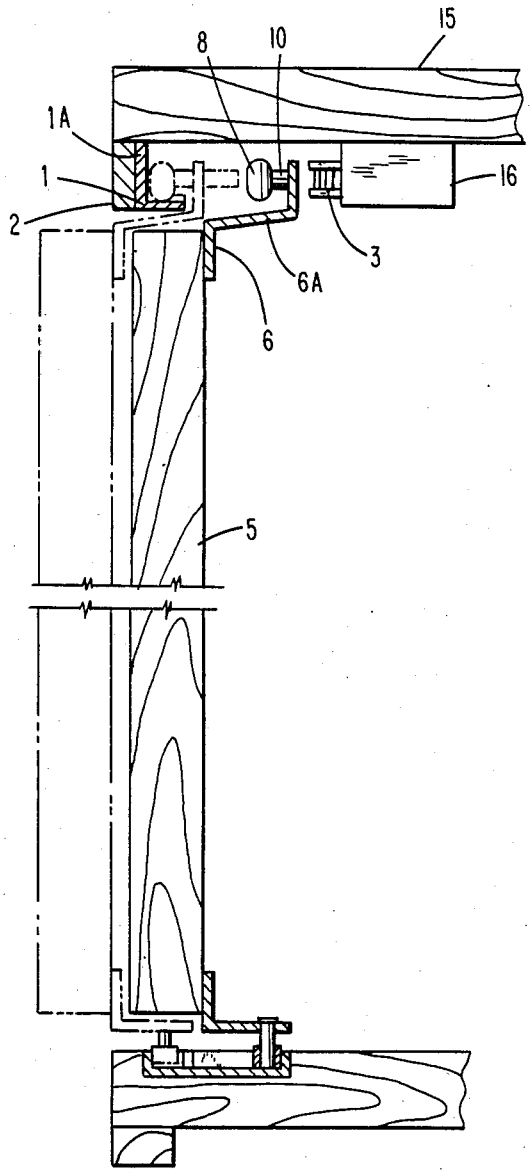
FIG. 5 is a vertical sectional view of the embodiment.
Figure 6:
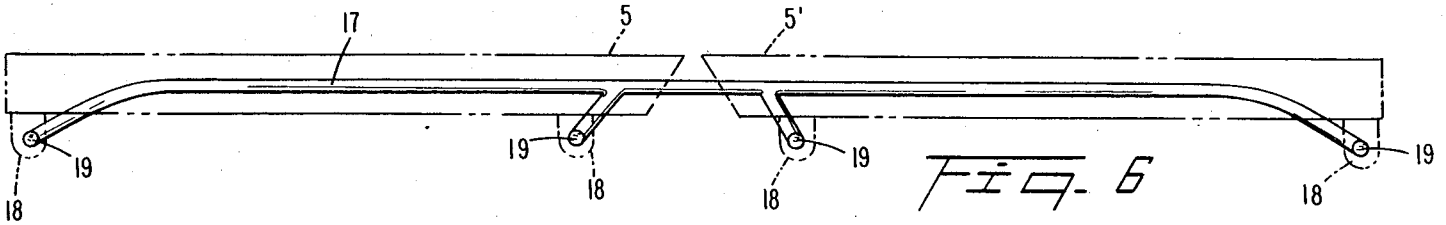
FIG. 6 is a plan view of an example of means for supporting the lower part of the sliding door.

A support for the lower part of the sliding door can be omitted, however, if required, the purpose being satisfied by providing, for example, a rail 17 to be formed along the path of door movement as shown in FIGS. 5 and 6 on the bottom board of the furniture and by movably fitting rollers 19 to be formed on the bottom end of the sliding door into the abovesaid rail 17, so that the door is stably supported.

The stoppers or stop surfaces 3B and 3B' provided for the swing arms 3 and 3' serve to prevent the hook members 12 and 12' from departing from the engaging pins 3A and 3A' due to abutting of the rear sides of the hook members 12 and 12' thereon, respectively, when the sliding door is drawn sideways from the closure position. In addition, when the sliding door is more strongly pressed sideways, the rear side of the hook member 12 pushes the stopper 3B to turn the swing arm 3 to a state as shown in FIG. 3, so that the sliding door can be opened by a single action along the sliding direction.

Figure 7:
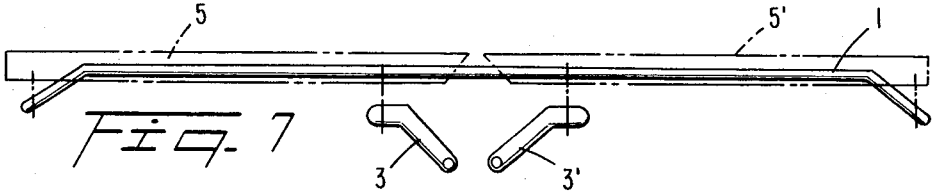
FIG. 7 is a schematic plan view illustrating the embodiment shown in FIGS. 1 through 5.
Figure 8:
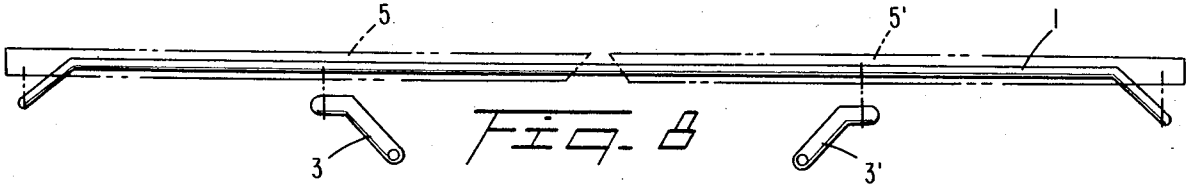
FIGS. 8 through 12 are views of other various embodiments of this invention similar to FIG. 7.

This invention can be embodied in various manners as will be described later. FIG. 7 is a plan view schematically showing an embodiment of a two-slidingdoor unit as described with reference to FIGS. 1 through 5, however, an arrangement of swing arms 3 and 3' so as to act at positions each corresponding to the midpoint of the sliding door 5 or 5' as shown in FIG. 8 may be applicable.

Figure 9:
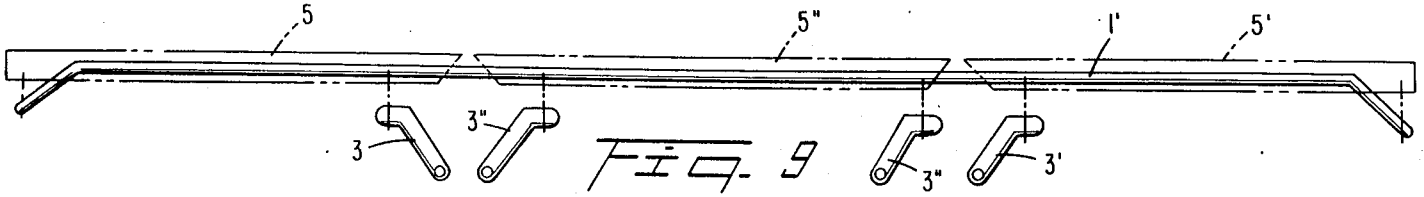

Further, as shown in FIG. 9, one more sliding door 5'' may be interposed between the left and the right sliding doors 5 and 5'. In this case, a pair of swing arms 3'' and 3'' structurally identical with those described earlier are disposed at both ends of the sliding door 5'' for drawing out this sliding door 5'' from the closure position thereof to the slide-starting position on the main rail. These swing arms 3'' and 3'' turn in the same direction as that of sliding of the door 5'' and synchronously therewith.

Figure 10:
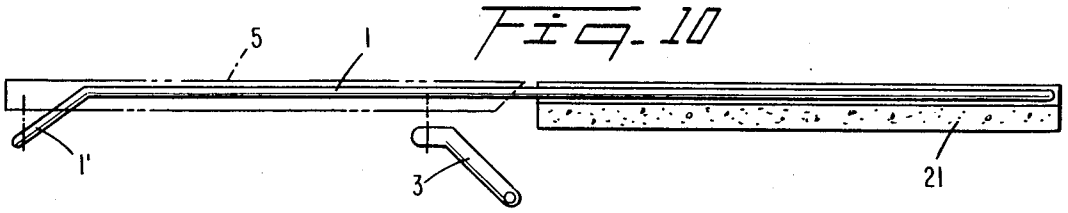
Figure 13:
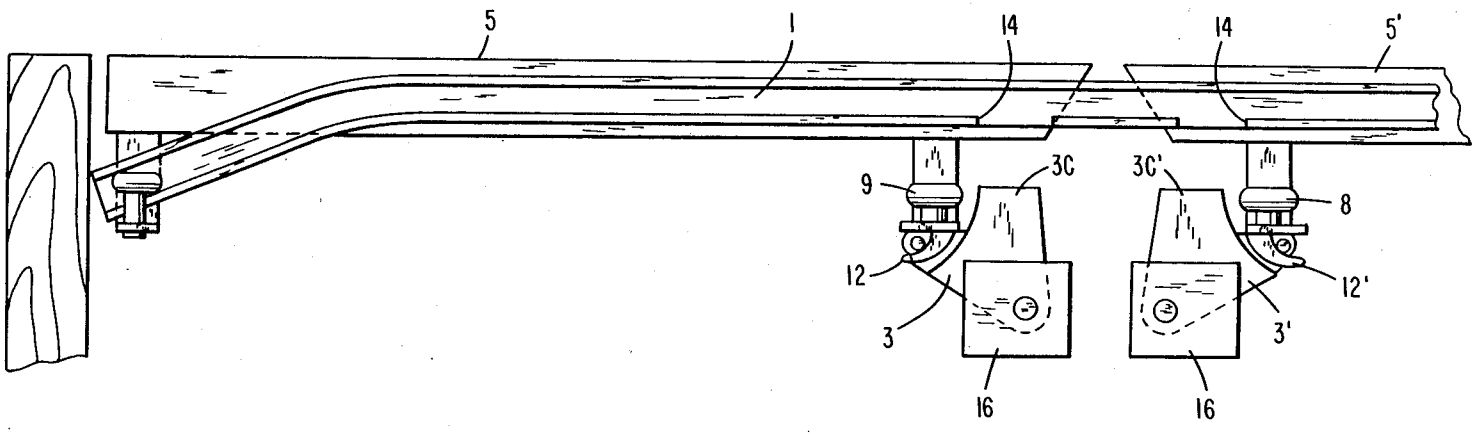
FIG. 13 is a partial plan view of another embodiment of the swing arms of the present invention.

Still further, as shown in FIG. 10, it is possible to form one side of a sliding door 5 into a stationary wall and to provide an extended part of the main rail 1 in front of the stationary wall 21. In this case, the sliding door can be used as a door for a living room. Furthermore, FIG. 13 illustrates another embodiment of the swing arms 3, and 3' of the present invention in which each of said arms 3 and 3' are provided with a stop surface 3C or 3C' to prevent falling off of the rollers 8 and 9 from the gateways 14 and 14 when the rollers are slid along the main rail 1.

Figure 11:
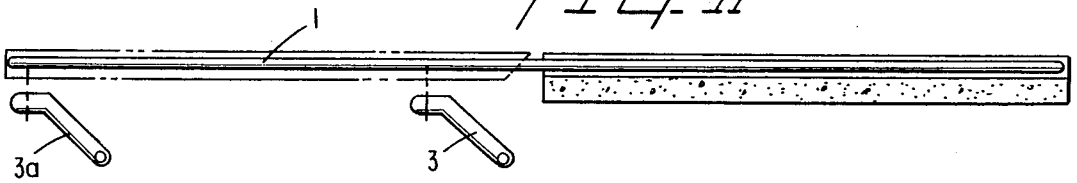
Figure 12:
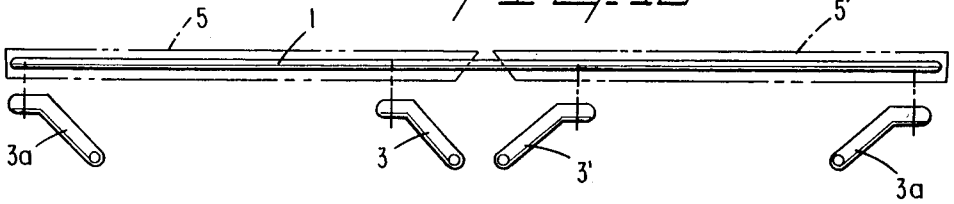

In any of the above-described embodiments, the main rail 1 is bent at both ends to form side lead-in rail 1', which however, may be straight as shown in FIGS. 11 and 12 so that both ends of each sliding door may be drawn back by the swing arms 3A of the same structure as that of the abovesaid ones. These various embodiments are all included in this invention.

As has been described heretofore, according to this invention, at least a roller at the end of sliding door to be guided is shifted from the drawn-back position to the main rail while retained by the swing arm, whereby are exhibited such effects as decrease in complexity in working component parts which is caused by connection of side lead-in rails to the main rail as in the conventional structure, elimination of noise and backlash at the junction of rails, and stable support and smooth movement of the sliding door because of positioning of a pair of rollers near both ends of the sliding door.

What is claimed is:

1. A flat sliding door unit in which a first sliding door lying in a closure position on a same vertical flat plane as that of an adjacent structure is shifted to a front side of said adjacent structure, comprising:

a main rail extending along an upper door frame;

a swing arm pivotally mounted adjacent said main rail and supported by said upper door frame;

said sliding door being provided with a pair of rollers rolling along said main rail and respectively secured to the upper end of the sliding door, one of said rollers being mounted to a roller stay having an upper stay end projecting above the upper end of said door, said upper stay end further including a hook having a first surface forming a recess with said upper stay end, said recess facing towards the swing arm and a second surface facing in the opening direction of said door, said swing arm being provided with an engaging pin at a tip thereof, said tip being formed with a pair of upper and lower extension arms between which said engaging pin extends, said tip further including a stop surface formed between said arms, said hook detachably engaging said engaging pin to retain the door in the closure position with said pin disposed within the recess and said swing arm pivoted into a first position away from the main rail, initial movement of the door causing pivoting of the swing arm towards the main rail through a predetermined angle and retention of the pin in the recess caused by contact between the stop surface and second hook surface during pivotal movement of the swing arm until said swing arm pivots through said predetermined angle to shift the roller onto the main rail for sliding movement of the door to an open position.

2. A flat sliding door unit as set forth in claim 1, wherein said stucture is a stationary wall provided on the side adjacent the sliding door and an extension of said main rail is provided on the front side of said stationay wall.

3. A flat sliding door unit as set forth in claim 1, wherein said structure is a second sliding door of the same mechanism as that of said first sliding door and provided adjacently to said first door and one of these two sliding doors can be shifted from the closure position on the flat plane common to both doors to the front side of the other sliding door.

4. The door unit of claim 1, wherein said first surface of the hook is concave and the second surface of the hook is convex.

5. The door unit of claim 4, wherein said stop surface of the swing arm is convex.

6. The door unit of claim 1, wherein said swing arm is connected to the upper door frame through a support having a stop edge against which the swing arm abuts to terminate pivotal movement through said predetermined angle in the door opening direction.

* * * * *